US006742276B1

(12) United States Patent
Anderson et al.

(10) Patent No.: US 6,742,276 B1
(45) Date of Patent: Jun. 1, 2004

(54) PLASTIC SUIT DRYING SYSTEM

(75) Inventors: Kent D. Anderson, East Longmeadow, MA (US); Les Case, Columbia, SC (US); Michael R. Fuller, Springfield, MA (US); David K. Welcher, II, Aiken, SC (US); Richard F. Tardy, Gaston, SC (US)

(73) Assignee: UniFirst Corporation, Springfield, MA (US)

( * ) Notice: Subject to any disclaimer, the term of this patent is extended or adjusted under 35 U.S.C. 154(b) by 0 days.

(21) Appl. No.: 10/413,770

(22) Filed: Apr. 15, 2003

Related U.S. Application Data

(60) Provisional application No. 60/372,827, filed on Apr. 15, 2002.

(51) Int. Cl.[7] ..... F28B 25/06

(52) U.S. Cl. ..... 34/204; 34/105; 34/106; 34/233

(58) Field of Search ..... 34/103, 104, 105, 34/106, 202, 204, 230, 232, 233

(56) References Cited

U.S. PATENT DOCUMENTS

| | | | | | |
|---|---|---|---|---|---|
| 1,602,315 | A | * | 10/1926 | Wood | 34/164 |
| 1,833,631 | A | * | 11/1931 | Wilsey | 34/233 |
| 2,883,092 | A | | 4/1959 | McMillan | |
| 3,511,252 | A | | 5/1970 | Kennedy | |
| 4,094,076 | A | | 6/1978 | Baslow | |
| 4,206,552 | A | | 6/1980 | Pomerantz et al. | |
| 4,682,424 | A | * | 7/1987 | Irving | 34/621 |
| 4,997,000 | A | | 3/1991 | Feast et al. | |
| 5,412,928 | A | | 5/1995 | Reithel | |
| 5,555,640 | A | * | 9/1996 | Ou | 34/202 |
| 5,592,750 | A | | 1/1997 | Eichten | |
| 5,607,652 | A | | 3/1997 | Hellmuth et al. | |
| 5,755,040 | A | | 5/1998 | Ou | |
| 5,862,606 | A | | 1/1999 | Jannach | |
| 5,953,830 | A | | 9/1999 | Jannach | |
| 5,987,773 | A | * | 11/1999 | Lipscy | 34/106 |
| 6,018,885 | A | * | 2/2000 | Hill | 34/202 |
| 6,499,230 | B1 | | 12/2002 | Fix | |
| 6,516,536 | B2 | | 2/2003 | Ryden | |

FOREIGN PATENT DOCUMENTS

EP 0 468 212 A1 1/1992

OTHER PUBLICATIONS

Copy of Certified English Translation dated Mar. 10, 2003 of German EPO Patent No. EP 0 468 212 A1.

* cited by examiner

*Primary Examiner*—Pamela A. Wilson
(74) *Attorney, Agent, or Firm*—Holland & Bonzagni, P.C.; John A. Kramer, Esq.

(57) ABSTRACT

A plastic suit drying system comprises a drying chamber with an air warmer, and a mobile dryer rack. The mobile rack has a wheeled air plenum base, a number of drying positions (each comprising three perforated air pipes protruding up from the base), and a flanged air inlet in the back of the base that mates with a connection flange in the drying chamber. Through this flanged connection hot air is forced into the base/plenum and then into the perforated pipes. For use, wet plastic suits are placed upside down on the drying positions. Then, the mobile rack is rolled into the drying chamber so that the rack's flange mates with the drying cabinet's connection flange. Next, the drying chamber doors are closed, and the drying cycle started, during which heated air is blown into the mobile rack plenum and up into the air pipes extending into the suits.

20 Claims, 8 Drawing Sheets

PLASTIC SUIT DRYING SYSTEM

This application claims priority from a Provisional Application, Serial No. 60/372,827, filed Apr. 15, 2002.

FIELD OF THE INVENTION

The present invention relates to drying devices, and, more particularly, to devices for drying plastic suits and similar items.

BACKGROUND

Many industries utilize plastic (i.e., synthetic material) environmental body suits, which are worn by workers for protection from hostile environments and/or substances, or for reducing contamination from the workers themselves in "clean rooms." Because such suits are largely self-contained and closed to the outside environment when worn, and because the synthetic materials used to make the suits do not "breathe" or absorb liquids to much of an extent, the suits tend to become interiorly soiled from human sweat and grime. Accordingly, the suits have to be both washed and dried on the inside and outside after use.

For drying plastic environmental suits, it is possible to let the suits air dry at room temperature. However, a simple study performed by the applicants of the present application indicated that at 52% relative humidity (a typical value), a plastic suit took around 90 minutes to air dry. Accordingly, air drying is impractical for institutions that clean a significant number of plastic suits.

To decrease drying time, it is known to direct heated air into the plastic suits. However, the devices that have been heretofore used for such purposes (e.g., drying cabinets), have not decreased drying turnaround time to the extent desired by the industry. More specifically, plastic suits are rather convoluted, and existing driers are not optimized for delivering air into the plastic suits' "nooks and crannies." This sometimes results in the suits not being completely dried. Moreover, existing driers do not apply heated air to the suits' cooling air channels (the air conditioning ducts in the walls of some environmental suits), and require a significant amount of time for suit changeover, i.e., to take one batch of suits out of the drying cabinet and insert the next batch of suits.

Accordingly, it is a primary object of the present invention to provide a drier for plastic environmental suits that significantly decreases the amount of time needed to completely dry the suits.

Another object of the present invention is to provide a plastic suit dryer that has quick changeover between one batch of suits and the next.

SUMMARY

A plastic suit drying system comprises: a fixed drying chamber; a mobile suit dryer cart or rack; and a compressed air warmer. The drying chamber is a cabinet with an interior accessible by front doors. For circulating air, a fan is located on top of the drying chamber. Air is guided to the fan by a fan intake plenum, which includes openings to the chamber interior, and to the outside via an intake filter. Additionally, a transition duct extends down the back of the drying chamber, and directs air from the fan output over a thermostatically-controlled heater positioned inside the transition duct and to a connection flange inside the cabinet that mates with a similar flange on the mobile rack. The mobile rack comprises: an air plenum (i.e., an enclosure with one air inlet and a plurality of air outlets for distributing heated air) mounted on four casters; thirty vertically-oriented, perforated air ducts or pipes that protrude from the top of the plenum (three for each suit); and a flanged air inlet or opening in the back of the plenum that mates with the connection flange on the fixed drying chamber. Through this flanged connection hot air is forced into the plenum and then into the perforated air ducts.

The compressed air warmer is fixed to a facility's existing compressed air distribution piping network. The compressed air warmer connects to individual plastic suits through a flexible hose manifold system (i.e., an array of ten hoses) having quick-release fittings that mate with similar, existing fittings on the plastic suits.

The plastic suit drying system works in a batch mode to dry wet plastic suits. Operation can be broken down into three cycles: a loading cycle, a drying cycle, and a cool-down cycle. In the loading cycle, the operator places each wet plastic suit upside down on one of the ten drying positions present on the mobile rack (each drying position includes three perforated air ducts: two that extend into the suit's legs, and a center duct that extends into the suit's torso). When all ten positions are filled, the mobile rack is rolled into the drying chamber so that the rack's flange mates with the drying cabinet's connection flange. Then, the operator connects the ten quick-release hoses from the compressed air warmer's manifold to the corresponding fitting on each plastic suit. The operator then closes the drying chamber doors, starts the drying cycle (via an electronic control), which turns on the fan and the low-pressure heater, and opens a valve that admits warmed compressed air into the hose manifold.

During the drying cycle, the fan draws outside air in through the filter until pressure builds up in the drying chamber, at which time the air is simply recirculated in the chamber. The fan blows air at low pressure down the transition duct, across the low-pressure heater, through the flanged opening, into the plenum of the mobile rack, and up into the air ducts extending up into the suits. High-pressure air from the facility's compressed air system is heated by the compressed air warmer, and is directed, via the hose manifold and hoses, into the suits' existing internal air distribution systems. The low-pressure air and the high-pressure air remove free water by a combination of sheer velocity and evaporation. Both air streams exhaust through the suit's "necks," which are located near the bottom of the drying chamber because the suits are upside-down on the drying positions. This air, still warm, is then drawn by the fan back past the external surfaces of the garments, where additional drying occurs, and up into the fan intake plenum and into the fan.

For decreasing drying time, a moisture exhaust damper may be opened on the back of the transition duct. This causes moist air to exit the drying chamber and drier outside air to enter through the intake filter.

When the drying cycle is over, a cool-down cycle begins, during which the fan continues to run, but the heating elements are turned off. The cool-down cycle renders subsequent handling of the suits by the operators less stressful for both the operator and garments.

BRIEF DESCRIPTION OF THE DRAWINGS

These and other features, aspects, and advantages of the present invention will become better understood with respect to the following description, appended claims, and accompanying drawings, in which:

DETAILED DESCRIPTION

Figure 1A:
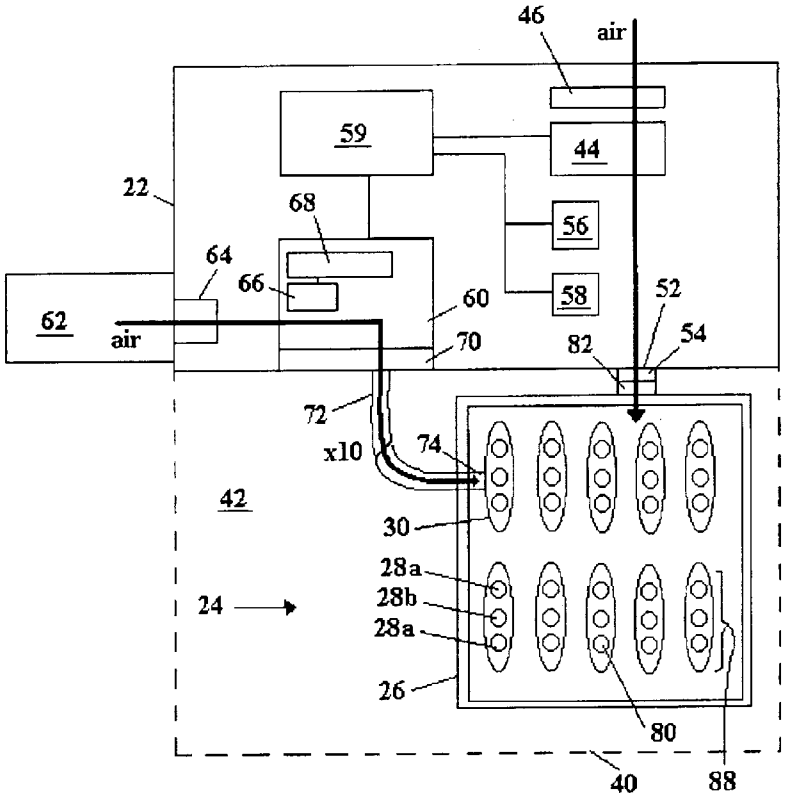
FIG. 1A is a schematic diagram of a plastic suit drying system according to the present invention.

Turning now to FIGS. 1A–9, a plastic suit drying system 20, according to the present invention, will now be described. The suit dryer 20 comprises a fixed drying is chamber 22 and a mobile suit dryer cart or rack 24 that fits inside the drying chamber 22. The mobile rack 24 includes a wheel-mounted air plenum base 26, and a plurality of vertically-oriented, perforated air ducts or pipes 28*a*, 28*b* that protrude from the top of the plenum. The mobile rack 24 is configured to mate with the interior of the drying chamber, such that heated air, provided by the drying chamber, is forced into the plenum 26 and through the perforated pipes 28*a*, 28*b*. In use, plastic suits 30 are positioned over the pipes 28*a*, 28*b* (e.g., the pipes extend into the interior of the suit), the mobile rack 24 is rolled into the drying chamber 22, and the drying chamber is activated, causing air to flow into the suits and dry the suits. The suits 30 are further dried by the heated air exiting the interior of the suits and passing over the outer surface of the suits.

FIGS. 1A and 2–4 show the fixed drying chamber 22 in detail. The drying chamber 22 is cabinet-like, with one or more doors 40 in the front and an interior space 42 accessible through the doors. A main circulation fan 44 is attached to the top of the drying chamber 22, and is configured to draw air from outside the chamber through an intake filter 46 and fan intake plenum 48. The output of the fan 44 is attached to a transition duct 50, 30 which runs from the top of the drying chamber 22, down its back, and through to an air output aperture 52 located near the bottom of the drying chamber 22. The air output aperture 52 is provided with a connection flange and gasket 54 (or other type of temporary connector). Also, one or more low-pressure heating elements (heaters) 56 are positioned inside the transition duct 50, for purposes of heating the air forced into the duct by the fan 44. A thermocouple 58 is also located inside the transition duct 50, "downstream" of the heaters 56. For controlling the fan 44 and the heaters 56, a main control unit 59 is also attached to the drying chamber 22, and is electrically connected to the fan, heaters, and thermocouple.

The plastic suit drying system 20 may also be provided with a compressed air warmer 60 attached to the drying chamber 22, for purposes of supplying heated, compressed air to the suits 30. The compressed air warmer 60 has a compressed air duct (not shown), which is connected to a facility's existing compressed air distribution piping network 62 through a safety valve 64. Additionally, a compressed air heater 66, located inside the air duct for heating compressed air, is powered and controlled by a control unit 68 (see FIG. 9), which may be electrically operably connected to the main control unit 59 for coordinated operation. Heated, compressed air is fed into a flexible hose manifold system 70, which distributes the air to an array of hoses 72, which can be connected to existing fittings 74 on the plastic suits. The hoses 72 may have quick-connect (quick-release) fittings for facilitating rapid attachment to and detachment from the suits. The compressed air warmer 60 may be provided with thermocouples 76 and/or pressure sensing switches 78 for facilitating heating of the compressed air and safety.

Regarding the hose fittings 74 on the plastic suits 30, it should be noted that many types of environmental suits have internal air circulation systems or ducts, which are accessed via quick-release couplings or other fittings attached to the suits. Typically, the air circulation ducts are used for cooling by an air conditioner unit attached to the suit via a hose. With this in mind, the hoses 72 should be provided with whatever type of connection means is required for the types of suits being dried (the use of adaptors or interchangeable connectors is also possible).

FIGS. 1A–3 and 5–7 show the mobile rack 24. The base of the mobile rack 24 is the plenum 26, which, as mentioned above, is an enclosure for distributing heated air. The plenum 26 has a plurality of air outlets 80 and a flanged air inlet 82 in the back of the plenum that mates with the connection flange 54 on the fixed drying chamber 22. Four casters 84 (or other types of wheels or the like) are attached to the bottom of the plenum 26, and one or more handrails 86 are attached to the top of the plenum 26, for allowing operators to move the mobile rack 24 into and out of the drying chamber 22.

Figure 5:
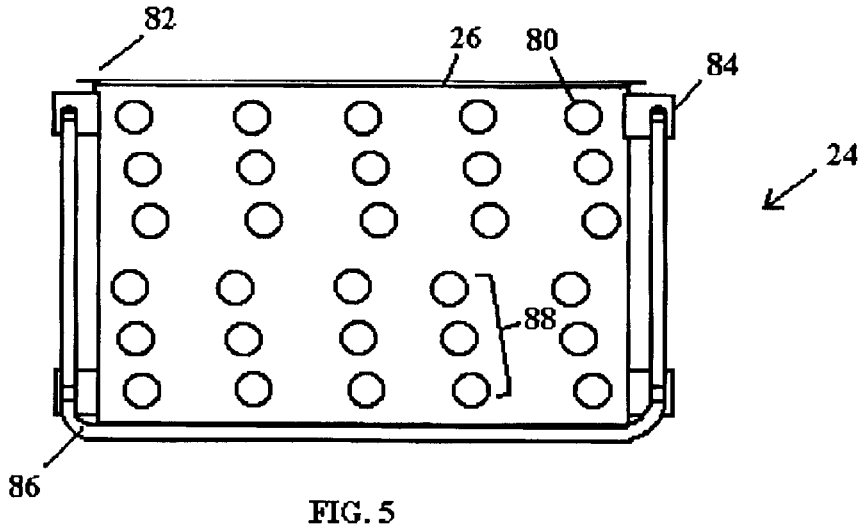
FIG. 5 is a top plan view of the mobile rack.

FIG. 5 shows the top of the mobile rack 24. As can be seen, the top of the plenum has thirty air outlets 80. The air outlets are arranged in linear groups of three in a 2×5 array, for a total of thirty "drying positions" 88. In other words, each drying position 88 has three linearly-arranged air outlets 80. Also, the drying positions 88 are slightly angled, which increases the amount of space between suits and enhances drying. The air outlets 80 are provided with screw threads for removably attaching the pipes/air ducts 28*a*, 28*b*, directly or via adapters. Of course, the pipes 28*a*, 28*b* can be permanently attached to the air outlets 80 as well.

Figure 6:
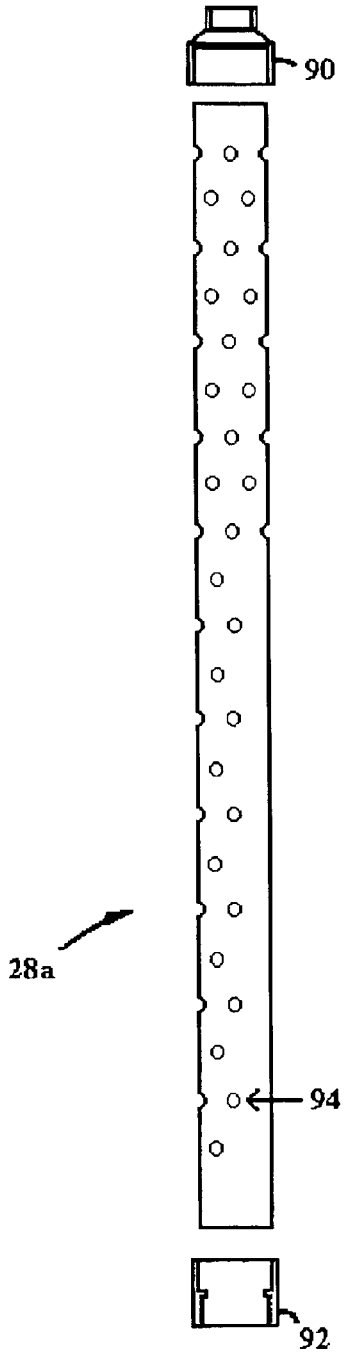
FIG. 6 is an elevation view of a perforated leg air duct or pipe.

FIG. 6 shows a first, "leg" pipe 28*a*, which is dimensioned to extend up into the leg of a plastic suit 30. The leg pipe 28*a* is a section of pipe (e.g., PVC pipe) or other rigid tubing having a reducing coupling 90 on one end (like an end cap with an opening for supplying air out the end of the pipe), and, if needed, a female adapter 92 on the other end for attachment to the air outlets 80. The pipe 28*a* has a number of holes 94 along its length. An exemplary configuration of the leg pipe, which provides optimized drying for suit interiors, is as follows: length of leg pipe=71" (1.8 m); diameter of leg pipe=4" (10.2 cm); and diameter of holes=½" (1.3 cm). The holes 94 are provided in groups spaced apart from each other every 3" (7.6 cm) from the top of the pipe 28*a*, for a total of twenty-two groups, with the holes in each group being arranged as follows: (i) the top 27" (69 cm.) of the pipe 28*a* has nine groups of four holes each, for a total of 36 holes; in alternating groups, the holes are spaced at 3, 6, 9 and 12 o'clock, and at 7:30, 10:30, 1:30, and 4:30 o'clock; and (ii) the lower portion of the pipe 28*a* has thirteen groups of holes, seven of which have two holes each that are spaced at 7:30 and 10:30 o'clock, and;alternating with the seven groups, six groups that have three holes each that are spaced at 6, 9, and 12 o'clock.

Figure 7:
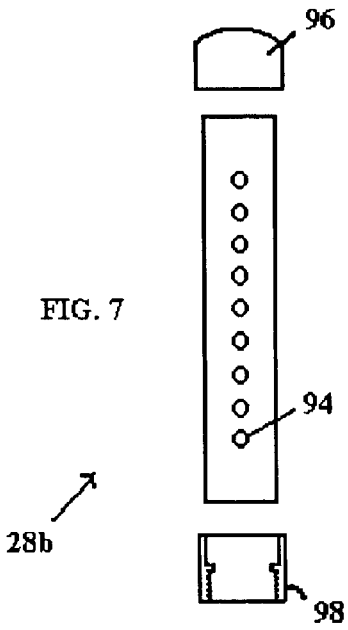
FIG. 7 is an elevation view of a perforated center air duct or pipe.

FIG. 7 shows a second, "center" or "torso" pipe 28*b*, which is dimensioned to extend up into the torso section of a plastic suit 30. The center pipe 28*b* is a section of pipe having an end cap 96 on one end (which may have an opening for supplying air out the end of the pipe), and, if needed, a female adapter 98 for attachment to the air outlets 80. The center pipe 28*b* has a number of holes 94 along its length. Exemplary dimensions of the pipe (which provide for optimal drying) are as follows: length of center pipe=24" (61 cm); diameter of center pipe=4" (10.2 cm); and diameter of holes=½" (1.3 cm). The holes 94 through the center pipe are provided in groups spaced apart from each other every 2" (5 cm), starting at 4" (10.2 cm) down from the top of the pipe 28*b*. This results in a total of nine groups of two holes each, with the holes in each group being spaced at 12 and 6 o'clock.

As should be appreciated, although the pipe dimensions and hole configurations discussed above and shown in the drawings have been found to be optimal for drying plastic suits, other configurations are possible as well (e.g., different lengths of pipe, hole diameters, and hole positioning), and are considered within the scope of the present invention.

Figure 1B:
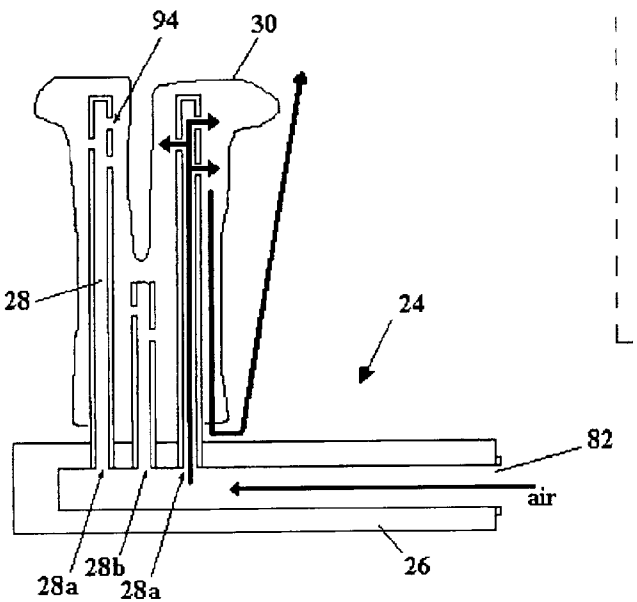
FIG. 1B (not to scale) is a schematic diagram, in cross-section, of a mobile suit dryer rack portion of the plastic suit drying system.
Figure 2:
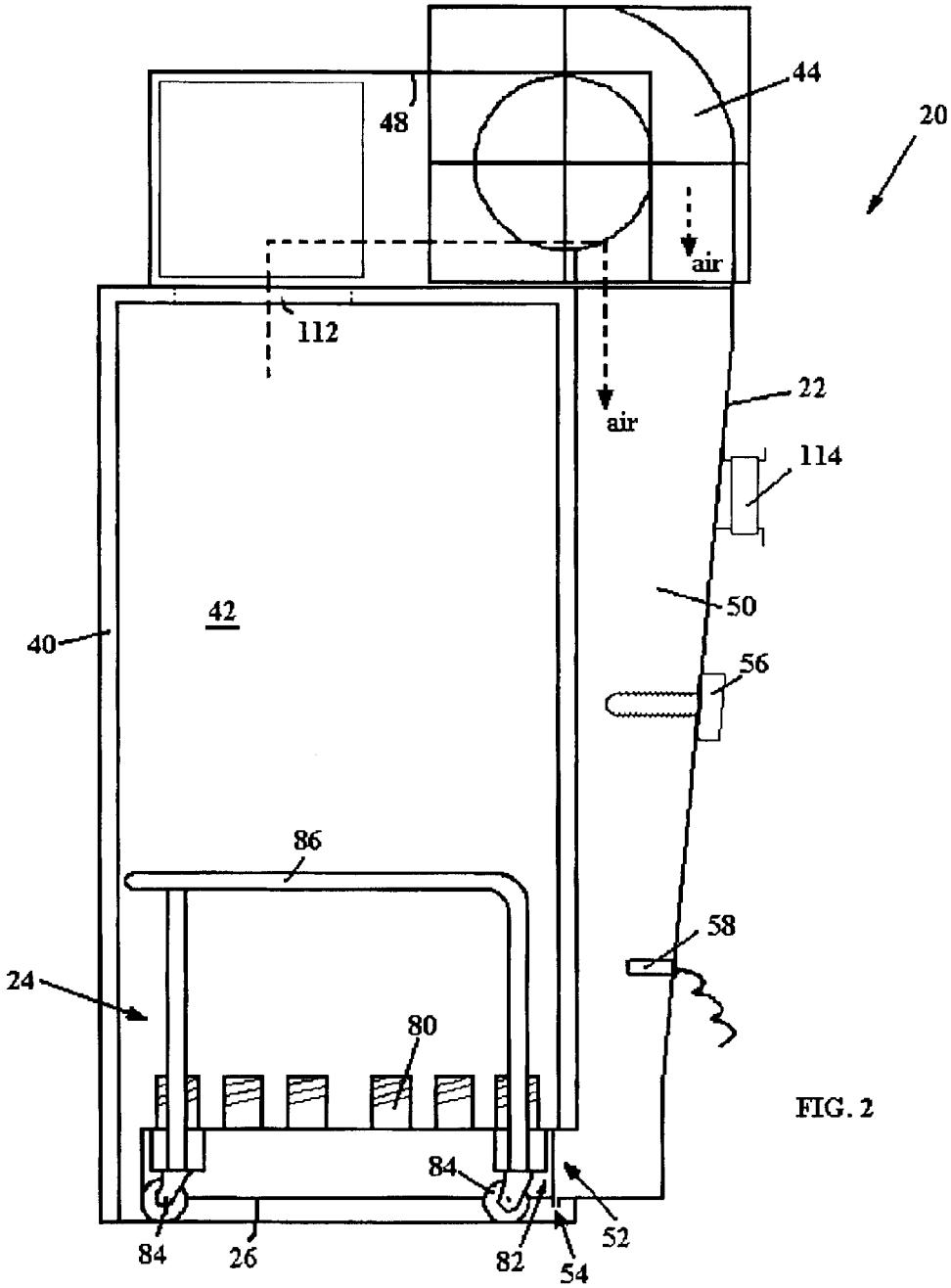
FIG. 2 is a right side elevation view of the plastic suit drying system.
Figure 3:
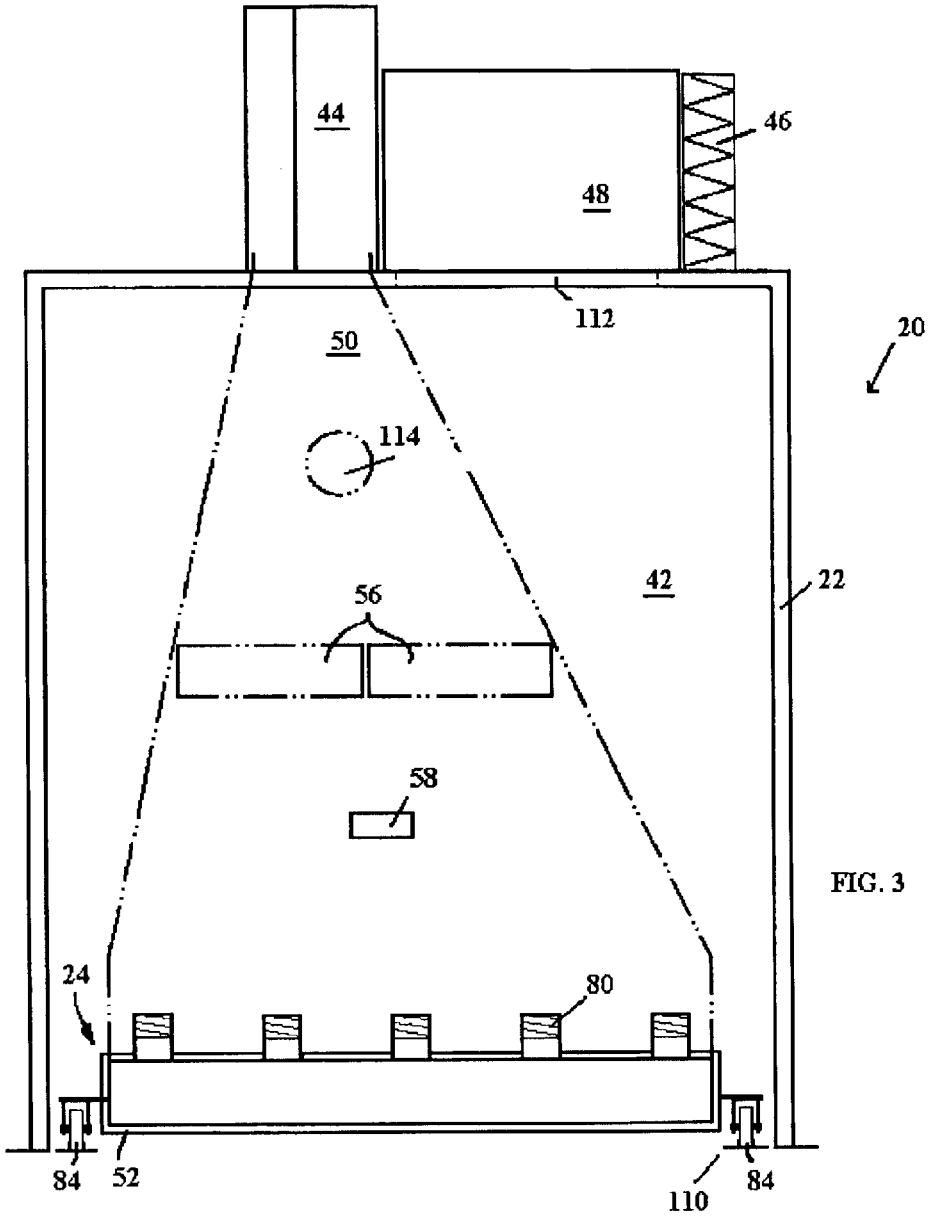
FIG. 3 is a front elevation view of the plastic suit drying system (note that portions of the mobile rack are not shown, for clarity)
Figure 4:
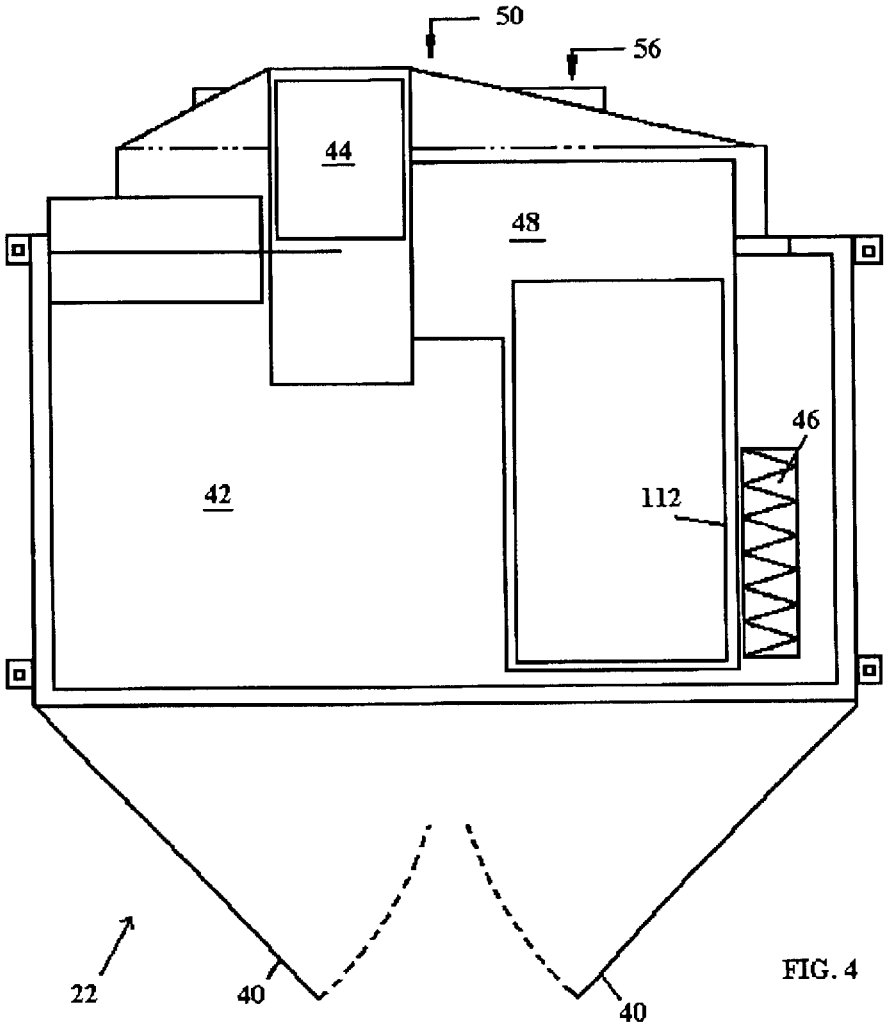
FIG. 4 is a top plan view of the plastic suit drying system.

FIGS. 1A and 1B best show how the pipes 28*a*, 28*b* are arranged on the mobile cart plenum 26. For each drying position 88 (group of three air outlets), a center pipe 28*b* is attached to the central air outlet, while two leg pipes 28*a* are attached to the outer two air outlets. Accordingly, the ten drying positions 88 in combination require a total of ten center pipes and twenty leg pipes. The center and leg pipes extend vertically up from the air outlets.

For drying suits, the plastic suit dryer 20 works in a batch mode to dry wet plastic suits 30. Operation can be broken down into three cycles: a loading cycle, a drying cycle, and a cool-down cycle.

In the loading cycle, an operator places each wet plastic suit 30 upside down (feet up) on one of the ten drying positions 88 present on the mobile rack, with the two leg pipes 28*a* extending up into the suit's legs, and the center pipe 28*b* extending up into the suit's torso, as shown schematically in FIG. 1B. Subsequently, when all ten positions 88 are filled (with ten suits 30), the mobile rack 24 is rolled into the drying chamber 22 so that the rack plenum's flanged air inlet 82 mates with the drying cabinet's connection flange 54. The floor of the drying chamber 22 may be provided with guide angles or markings 110 (see FIG. 3), such that when the casters 84 are rolled into and/or aligned with the guides 110, the flanged air inlet and connection flange align. In this position, the interior of the plenum 26 and the drying chamber's transition duct 50 are in fluid communication. Also, the mobile rack may be locked in place via a foot brake (not shown) attached to the mobile rack.

Once the mobile rack has been properly positioned inside the drying chamber, the operator connects the ten quick-release hoses 72 from the compressed air warmer's manifold 70 to the corresponding fittings on the plastic suits 30. Then, the operator closes the drying chamber doors 40, and starts the drying cycle by actuating the appropriate control(s) on the main control unit 59 (e.g., the operator sets a timer for running the fan). Additionally, the safety valve 64, located between the compressed air warmer 60 and the facility's existing compressed air distribution piping network 62, is opened.

When the drying cycle is initiated, the main control unit 59 causes the fan 44 to draw air into the transition duct 50. A Dwyer diaphragm-type pressure switch may be positioned inside the duct 50 to sense the air pressure difference across the heaters 56 inside the duct 50; a pressure difference indicates that air is flowing across the heaters, which then can be safely activated by the main control unit 59. During the drying cycle, as indicated in FIGS. 1A and 1B, air is blown by the fan 44 at low pressure across the low-pressure heaters 56, through the transition duct's air output aperture 52, into the mobile rack's plenum 26, and up into the pipes 28*a*, 28*b* extending up into the suits 30. Heated air exits the pipes 28*a*, 28*b* through the pipe holes 94, and enters the interior of the suits 30.

While the main circulation fan 44 blows air into the interior space 42 of the drying chamber 22, high-pressure air from the facility's compressed air system 62 is heated by the compressed air warmer 60, and is directed, via the hose manifold 70 and hoses 72, into the suits' existing internal air distribution systems. The low-pressure air and the high-pressure air remove free water by a combination of sheer velocity and evaporation. Both air streams exhaust through the suit's "necks," which are located near the bottom of the drying chamber (i.e., proximate the top of the plenum 26).

Once the still-warm air exit the suits 30, it is drawn by the fan back past the external surfaces of the garments, where additional drying occurs. This is accomplished by providing a fan-intake opening 112 between the interior 42 of the drying chamber 22 and the fan 44, where the fan 44 blows air down the transition duct 50 and sucks air in the chamber interior 42 up through the opening 112 and plenum 48. Thus, the fan, transition duct, rack, chamber interior, opening, and intake plenum form a partially-closed air circulation circuit, where outside air is drawn through the filter 46 mainly upon startup, i.e., before air pressure builds up in the drying chamber (air may also be drawn in through the filter because of leaks in the cabinet or when an exhaust is opened, as discussed immediately below).

For further hastening drying time, the drying chamber 22 may be provided with a moisture removal damper 114, which is electrically and/or pneumatically operably connected to the main control unit 59. The damper 114 is located on the back of the transition duct 50, and provides an electrically—and/or pneumatically-controllable opening between the transition duct 50 and the facility's existing ventilation exhaust system (not shown). When the temperature is warm but not quite at the set point of the low-pressure thermocouple, e.g., at about 125° F., the damper 114 is opened, lowering the humidity of the drying chamber, and resulting in accelerated drying. More specifically, before the exhaust damper 114 is opened, air circulates through the chamber 22, but does not exit the chamber. As such, the air's level of moisture content increases. However, when the exhaust damper 114 is opened, a portion (10% or so) of the high-humidity airflow exhausts through the damper and into the facility's exhaust system. Since the pressure in the interior of the chamber is greater than the pressure in the exhaust system, air only exits the exhaust damper. At the same time, during the moisture removal phase, the pressure in the chamber dips slightly, causing dry outside air to be drawn into the drying chamber through the filter by the fan.

During this time, with the fan 44 and heaters 56 operating, the temperature in the chamber 22 continues to rise (with the exhaust damper open, the temperature may rise less rapidly because cooler outside air enters the chamber and has to be heated). As the temperature approaches about 130° F., the heaters begin to operate in a proportional band of the controller 59. Here, the heaters 56 are energized for an amount of time that is proportional to the deviation of the chamber temperature from the setpoint (130° F.), such that the closer the chamber temperature gets to the setpoint, the less the heaters are energized.

When the drying cycle is over, as determined by the main control unit 59 (via an internal timer, an operator-set timer, or the like), a cool-down cycle begins. During the cool-down cycle, the main fan 44 continues to run, but the heaters 56 are turned off. This cools the suits, causing the subsequent handling of the suits by the operators to be less stressful for both the operator and for the garments. Of course, at some point prior to this, the compressed air flow to the suits is halted, via automatic control or the operator shutting the valve 64 (either the entire compressed air warmer 60 can be shut down once the cool-down cycle begins, or the compressed air heater 66 can be shut off, with compressed air still flowing, to facilitate cool down).

Next, once the cool-down cycle is finished, the main control 59 shuts off the fan 44 (and the compressed air flow is halted), and the operator opens the doors 40, removes the hoses 72 from the suits 30, and pulls out the mobile rack 24 and dried suits. The following gives an experimentally-validated, quantitative indication of the time saved in drying using the present system:

| TYPE OF DRYING OPERATION | DRYING TIME FOR PLASTIC SUITS |
|---|---|
| Room temperature air dry at 52% relative humidity | 86 minutes |
| Air heated to 127° F. (53° C., at a flow rate of 500–600 fpm, at 52% relative humidity, using present invention | 14 minutes |

Figure 8:
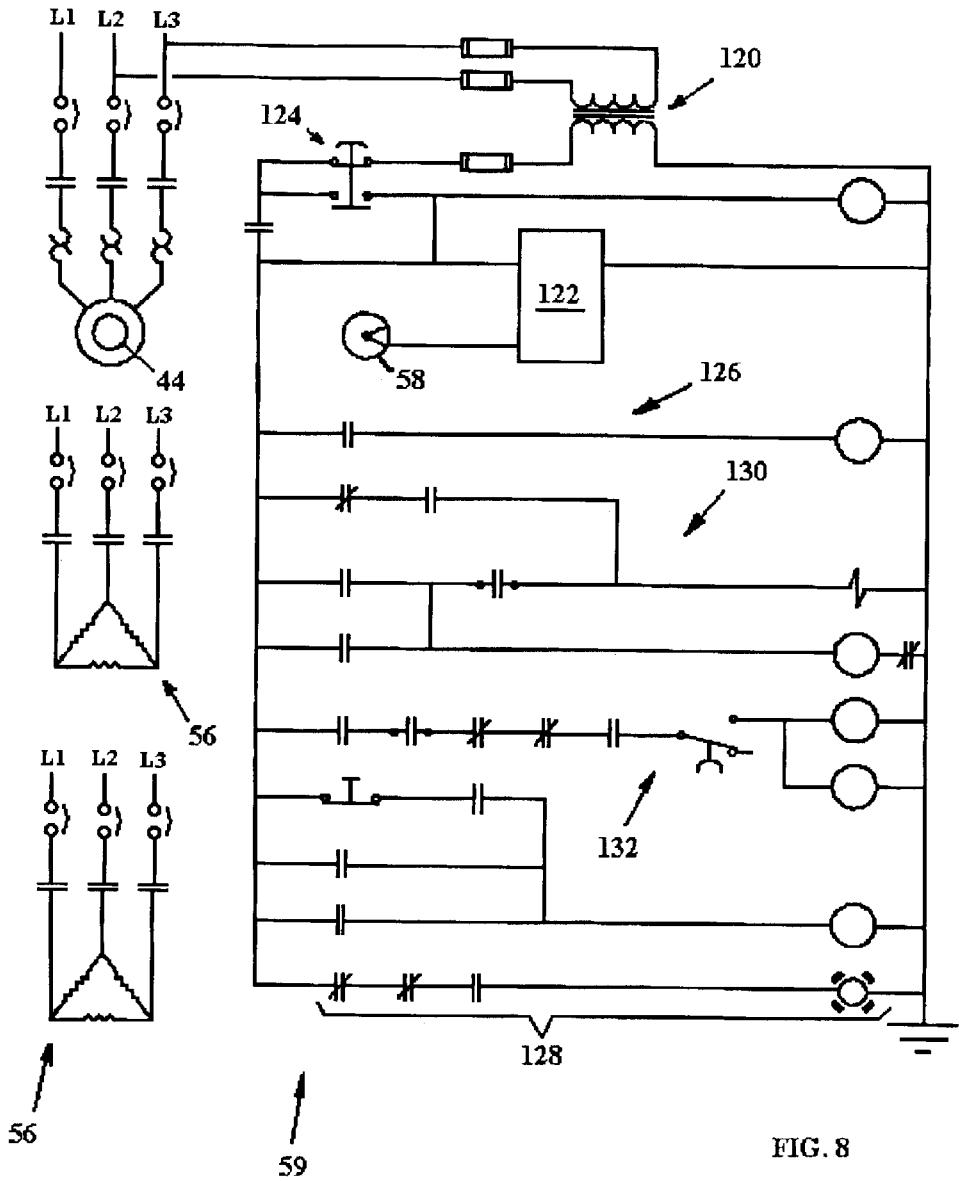
FIG. 8 is an electrical schematic diagram of a main controller for the plastic suit drying system.

FIG. 8 shows a sample control unit 59. As indicated, the control unit is electrically attached to the heaters 56 and the fan 44. The control unit may include a transformer 120, temperature controller 122 (connected to the thermocouple 58), and various additional elements, such as an emergency stop 124, mechanical timer 126, an end-of-cycle buzzer 128, exhaust damper control 130, and an air-flow proving circuit 132.

Figure 9:
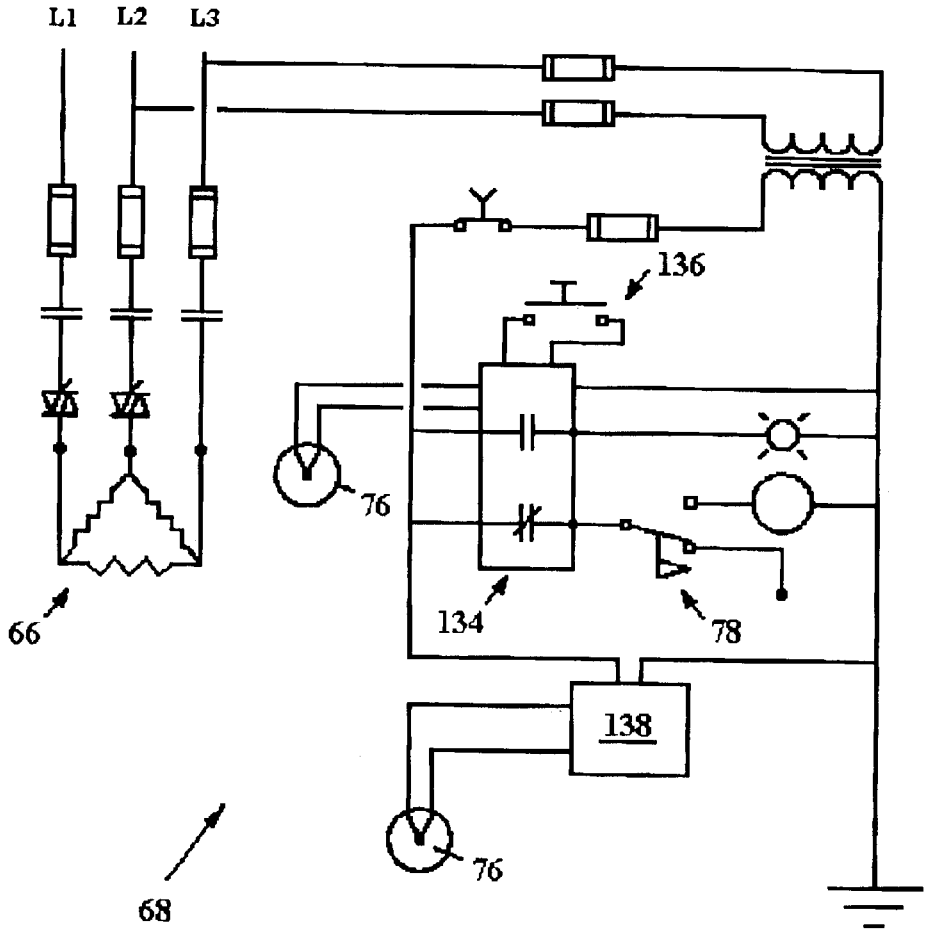
FIG. 9 is an electrical schematic diagram of a controller for a compressed air warmer portion of the plastic suit drying system.

FIG. 9 shows a sample compressed air heater control unit 68. The control unit 68 may include a hi-limit control circuit 134 (connected to one of the thermocouples 76) with a reset 136, a pressure-sensing switch 78, and an SCR control and process air temperature control circuit 138.

While the fan and low-pressure heating elements form one suitable type of air warming unit for the drying chamber, other types/configurations of air warming units are possible as well, e.g., an integrated fan/heater unit on the top of the cabinet.

Since certain changes may be made in the above-described plastic suit drying system, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Having thus described the invention, what is claimed is:

What is claimed is:

1. A suit drying system,comprising:

a. a drying cabinet comprising: an interior accessible by at least one door; a transition duct terminating at a connector positioned in the cabinet interior; and an air warming unit configured to blow heated air through the transition duct and out the connector; and b. a mobile suit drying rack comprising: a wheeled air plenum having a plenum interior that terminates at an air inlet configured to mate with the connector; and a plurality of drying stations attached to a top of the wheeled air plenum and in fluid communication with the plenum interior, each of said drying stations having at least one perforated pipe upstanding from the top of the wheeled air plenum; wherein for drying suits: the suits are respectively placed upside down on the drying stations, with the perforated pipes extending up into the suits; the drying rack is wheeled into the cabinet interior and the cabinet door is shut; and the air warming unit is activated for blowing heated air through the transition duct, out the connector, into the interior of the wheeled air plenum, through the perforated pipes, and into the interiors of the suits.

2. The suit drying system of claim 1 wherein each drying station comprises two leg perforated pipes and a torso perforated pipe, wherein the torso perforated pipe is positioned between the two leg perforated pipes and is shorter than the two leg perforated pipes.

3. The suit drying system of claim 2 wherein each perforated pipe is about four inches in diameter and has a plurality of holes each about one-half inch in diameter.

4. The suit drying system of claim 2 wherein:

a. the leg perforated pipes and the torso perforated pipes of each drying station are linearly aligned; and b. the drying stations are angled with respect to the wheeled air plenum.

5. The suit drying system of claim 4 wherein each perforated pipe is about four inches in diameter and has a plurality of holes each about one-half inch in diameter.

6. The suit drying system of claim 1 further comprising a compressed air warmer system attached to the drying cabinet and having a hose manifold and an array of hoses connected to the hose manifold, said compressed air warmer system being configured to supply heated, compressed air to suits on the mobile suit drying rack in the drying cabinet when the hoses are attached to the suits and the compressed air warmer system is activated.

7. The suit drying system of claim 1 wherein: the transition duct extends down the back of the drying cabinet from the top of the drying cabinet to near the bottom of the drying cabinet; and the air warming unit comprises: a fan located on top of the drying cabinet and in fluid communication with the transaction duct; at least one heater located in the interior of the transition duct; and a controller electrically connected to the fan and heater for controlling the fan and heater.

8. The suit drying system of claim 7 wherein the air warming unit further comprises a moisture removal damper attached to the transition duct and electrically connected to the controller, said moisture removal damper being configured for selectively providing an opening between the transition duct and an exterior of the drying cabinet, for reducing moisture in the drying cabinet.

9. The suit drying system of claim 1 wherein the drying cabinet further comprises a moisture removal damper attached to the transition duct and configured for selectively providing an opening between the transition duct and an exterior of the drying cabinet, for reducing moisture in the drying cabinet.

10. A suit drying system comprising:

a. a drying cabinet comprising: an interior accessible by at least one door; a transition duct extending down the back of the drying cabinet and terminating at a connector positioned in the cabinet interior near the bottom of the drying cabinet; a fan located on top of the drying cabinet and in fluid communication with the transaction duct; at least one heater located in the interior of the transition duct; and a controller electrically connected to the fan and heater for controlling the fan and heater; and b. a mobile suit drying rack comprising: a wheeled air plenum having a plenum interior that terminates at an air inlet configured to mate with the connector; and a plurality of drying stations attached to a top of the wheeled air plenum and in fluid communication with the plenum interior, each of said drying stations comprising two leg perforated pipes and a torso perforated pipe, wherein: the torso perforated pipe is positioned between the two leg perforated pipes and is shorter than the two leg perforated; and the leg perforated pipes and the torso perforated pipes of each drying station are linearly aligned and the drying stations are angled with respect to the wheeled air plenum;

c. wherein for drying suits: the suits are respectively placed upside down on the drying stations, with the perforated pipes extending up into the suits; the drying rack is wheeled into the interior of the drying cabinet such that the air inlet mates with the connector; the at least one cabinet door is shut; and the fan and heater are activated for blowing heated air through the transition duct, out the connector, into the interior of the wheeled air plenum, through the perforated pipes, and into the interiors of the suits.

11. The suit drying system of claim 10 wherein the drying cabinet further comprises a moisture removal damper attached to the transition duct and configured for selectively providing an opening between the transition duct and an exterior of the drying cabinet, for reducing moisture in the drying cabinet.

12. The suit drying system of claim 10 further comprising a compressed air warmer system attached to the drying cabinet and having a hose manifold and an array of hoses connected to the hose manifold, said compressed air warmer system being configured to supply heated, compressed air to suits on the mobile suit drying rack in the drying cabinet when the hoses are attached to the suits and the compressed air warmer system is activated.

13. A suit drying system comprising:

a. a drying cabinet having an interior and a heated air source; and b. a suit drying rack comprising: a wheeled air plenum configured to mate with the heated air source in the drying cabinet; and a plurality of drying stations attached to a top of the wheeled air plenum, each of said drying stations having at least one perforated pipe upstanding from the top of the wheeled air plenum.

14. The suit drying system of claim 13 wherein:

a. each drying station comprises: two leg perforated pipes; and a torso perforated pipe shorter than the leg perforated pipes and being positioned between the leg perforated pipes, said leg perforated pipes and said torso perforated pipe being linearly aligned; and b. the drying stations are angled with respect to the wheeled air plenum.

15. The suit drying system of claim 14 wherein each perforated pipe is about four inches in diameter and has a plurality of holes each about one-half inch in diameter.

16. The suit drying system of claim 13 further comprising a compressed air warmer system attached to the drying cabinet and having a hose manifold and an array of hoses connected to the hose manifold, said compressed air warmer system being configured to supply heated, compressed air to suits on the suit drying rack in the drying cabinet when the hoses are attached to the suits and the compressed air warmer system is activated.

17. The suit drying system of claim 13 wherein the heated air source comprises: a transition duct terminating at a connector positioned in the cabinet interior; and an air warming unit configured to blow heated air through the transition duct and out the connector.

18. The suit drying system of claim 17 wherein the transition duct extends down the back of the drying cabinet from the top of the drying cabinet to near the bottom of the drying cabinet; and the air warming unit comprises: a fan located on top of the drying cabinet and in fluid communication with the transaction duct; at least one heater located in the interior of the transition duct; and a controller electrically connected to the fan and heater for controlling the fan and heater.

19. The suit drying system of claim 18 wherein the air warming unit further comprises a moisture removal damper attached to the transition duct and electrically connected to the controller, said moisture removal damper being configured for selectively providing an opening between the transition duct and an exterior of the drying cabinet, for reducing moisture in the drying cabinet.

20. The suit drying system of claim 13 wherein the drying cabinet further comprises a moisture removal damper for selectively providing an opening between the interior of the drying cabinet and an exterior of the drying cabinet, for reducing moisture in the drying cabinet.

* * * * *

UNITED STATES PATENT AND TRADEMARK OFFICE

CERTIFICATE OF CORRECTION

PATENT NO. : 6,742,276 B1
DATED : June 1, 2004
INVENTOR(S) : Kent D. Anderson et al.

It is certified that error appears in the above-identified patent and that said Letters Patent is hereby corrected as shown below:

Column 3,
Line 51, change “duct 50, 30 which” to -- duct 50, which --.

Column 5,
Line 2, change “and;alternating” to -- and, alternating --.

Column 8,
Line 2, delete “What is claimed is:”.

Signed and Sealed this

Twenty-third Day of November, 2004

JON W. DUDAS
*Director of the United States Patent and Trademark Office*